US008235621B2

(12) United States Patent
Robinson

(10) Patent No.: US 8,235,621 B2
(45) Date of Patent: Aug. 7, 2012

(54) GROUT DISPENSING SYSTEM AND DEVICE

(76) Inventor: Vernon Robinson, Denver, CO (US)

( * ) Notice: Subject to any disclaimer, the term of this patent is extended or adjusted under 35 U.S.C. 154(b) by 473 days.

(21) Appl. No.: 12/473,278

(22) Filed: May 28, 2009

(65) Prior Publication Data

US 2010/0300579 A1 Dec. 2, 2010

(51) Int. Cl.
*A47L 13/30* (2006.01)

(52) U.S. Cl. ..... 401/263; 401/137; 401/139; 401/150; 401/176; 401/182; 401/195; 401/266; 401/289; 222/191; 222/386; 239/320; 239/532; 239/548; 15/235.3; 15/245

(58) Field of Classification Search ..... 401/118, 401/137–139, 144, 149, 150, 170, 171, 176, 401/177, 182, 195, 261, 263, 265, 266, 289; 222/174, 191, 379, 386; 239/146, 320, 532, 239/548, 566, 722, 754; 15/235.3, 245
See application file for complete search history.

(56) References Cited

U.S. PATENT DOCUMENTS

| | | | | |
|---|---|---|---|---|
| 3,562,808 | A * | 2/1971 | Whitley, Jr. | 222/385 |
| 4,778,298 | A * | 10/1988 | Shin et al. | 401/137 |
| 6,260,743 | B1 * | 7/2001 | Mazzenga | 401/137 |
| 6,446,884 | B1 * | 9/2002 | Utter et al. | 239/532 |
| 6,547,469 | B2 * | 4/2003 | Vito | 401/138 |
| 7,008,130 | B1 * | 3/2006 | Hill | 401/289 |
| 7,556,447 | B2 * | 7/2009 | Bruggeman et al. | 401/176 |
| 7,614,813 | B1 * | 11/2009 | Yande | 401/150 |

* cited by examiner

*Primary Examiner* — Steven J Ganey
(74) *Attorney, Agent, or Firm* — Jerry D. Haynes; Law Office of Jerry D. Haynes

(57) ABSTRACT

The present invention relates to a grout dispensing system comprising: a suction mechanism that draws grout material into an elongated tube; a dispensing channel attached to a first end of the elongated tube; a suction handle extending through the elongated tube, where the suction handle draws grout into the tube when moved in a first direction and dispenses grout into the dispensing channel when moved in a second direction; a plurality of dispensing tips disposed below the dispensing channel; and a squeegee on one side of the dispensing channel. In one exemplary embodiment, the suction mechanism includes a suction cup at one end of the suction handle, where said suction cup is within said elongated tube; a suction opening at a lower end of the elongated tube; and a suction tube extending from the suction opening. The distal end of suction tube lies in a deposit of grout.

12 Claims, 1 Drawing Sheet

GROUT DISPENSING SYSTEM AND DEVICE

BACKGROUND OF THE INVENTION

1. Field of Invention

The present invention relates to a grout application system and device that enables the user to apply grout to multiple gaps in one continuous stroke.

2. Description of Related Art

Grout is a fluid mortar material used to fill gaps between tiles mounted on an underlying surface. The grout is applied between the tiles in a pliable state and is allowed to dry and harden to provide a durable protective layer between the tiles. Traditionally the method to apply grout involves using a spreading tool such as a trowel to spread grout in a thin layer over the tiles with the resulting grout then deposited in the gaps or the recesses between the tiles. Excess grout is mainly scraped or sponged from the tiles exposed on the tile surface. Once the grout is applied, the grout is compressed and shaped to form a smooth joint between the adjacent tiles. The process can be somewhat laborious and may involve actually working on ones hands and knees or in squatting positions.

Over time application tools and dispensing systems have been developed to alleviate some of the manual labor associated with the application of grout. The use of application tools and dispensing systems speeds up the process of application and alleviates some of the manual labor associated with the application of grout between tiles. Some manual grout dispensers include piston and plunger systems that force grout out of a nozzle under pressure between a gap and require manual pressing of the piston/plunger into a cylinder to generate dispensing pressure. Some of the systems of the prior art include a single dispensing nozzle where grout is applied to a single gap at a time. Such a piston plunger dispensing system is disclosed in U.S. Pat. No. 6,152,332. Such a system, however, limits the user to application in a single gap and requires repetitive manual filling and dispensing of the piston with grout material.

Another example of a prior art grout applicator is disclosed within U.S. Pat. No. 4,230,356 which discloses a grout applicator that is enclosed in an elongated blade mounting member and a flexible grout application blade that removably connects to a supporting member. The applicator of the '356 patent helps to alleviate the use of a hand trowel and eliminates working on ones hands and knees when applying grout. U.S. Pat. No. 5,379,479 discloses a spread blade housing that assists the user to apply grout over a gap and again includes an extended arm that enables the user to stand while applying the grout. The drawbacks of the prior art include the limitations with respect to the number of gaps that can be grouted within a single stroke and the required bending or squatting when using some applicators.

SUMMARY OF THE INVENTION

The present invention relates to a grout dispensing system comprising: a suction means, where said suction means draws grout material into an elongated tube; a dispensing channel attached to a first end of the elongated tube; a suction handle extending through the elongated tube, where the suction handle draws grout into the tube when moved in a first direction and dispenses grout into the dispensing channel when moved in a second direction; a plurality of dispensing tips disposed below the dispensing channel; and a squeegee on one side of the dispensing channel. In one exemplary embodiment, the suction means includes a suction cup at one end of the suction handle, where said suction cup is within said elongated tube; a suction opening at a lower end of the elongated tube; and a suction tube extending from the suction opening. The distal end of suction tube lies in a deposit of grout.

DETAILED DESCRIPTION

The present invention relates to a grout rake application device that enables the user to maximize grout application in an efficient and effective manner. The grout rake according to the present invention alleviates the necessity of kneeling down but also speeds up the dispensing of the grout by providing a plurality of dispensing outlets evenly spaced in line with the gaps associated with tile. The grout rake according to the present invention uses a pressure system in order to pull the grout material into the dispensing tube and enables the user to apply the grout through the dispensing tube. The grout rake includes a squeegee broom to assist in application of the grout.

Figure 1:
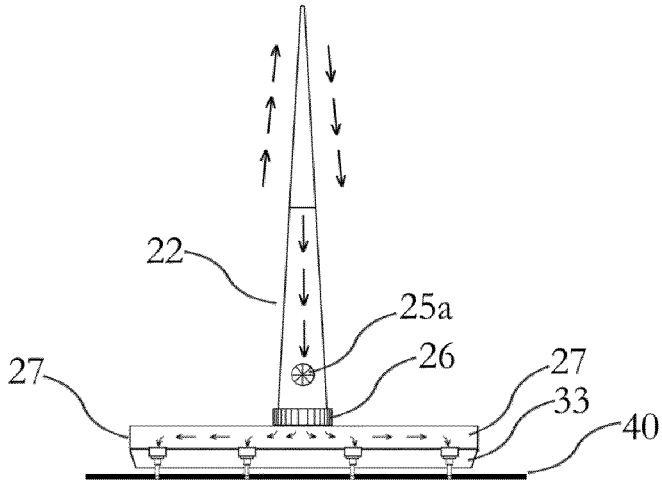
FIG. 1 depicts a front view of the grout rake according to the present invention.

FIG. 1 depicts a front view of the grout rake 20 according to the present invention. The grout rake 20 includes a grout tube 22 that, in one exemplary embodiment, extends vertically up to 4½ to 5 feet in height. At the bottom of the grout tube 22, the tube 22 intersects with a grout-dispensing channel 27, which runs horizontally to floor tiles 40. The dispensing channel 27 connects to the grout tube 22 via the inside cap 26. A suction opening 25*a* is also depicted that provides a means for the entry of grout into grout tube 22. A squeegee 33 is mounted on one side of the grout-dispensing channel 27 that provides a means to squeegee and wipe the grout as it is applied to the gaps within the tile.

Arrows within the group tube 22 depict the flow of grout into and out of the grout tube 22. Grout material is suctioned into the grout tube 22 and then dispensed in the downward direction through the grout-dispensing channel 27. A plurality of dispensing tips is shown below the dispensing channel that provides a means to apply the grout to a plurality of gaps simultaneously.

Figure 2:
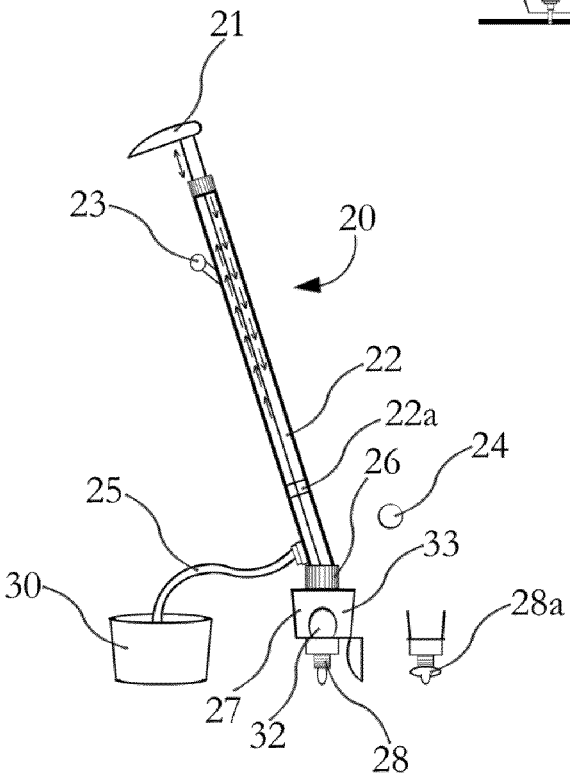
FIG. 2 depicts a perspective view of the grout rake according to the present invention.

FIG. 2 depicts a perspective view of the grout rake system according to the present invention. Further shown in FIG. 2 are a grip handle 23 and a grout-dispensing handle 21. The grout-dispensing handle 21 is pulled upward in a vertical direction in order to suction grout through the suction tube 25 from a grout bucket 30. The grout enters into the grout tube 22 through the suction opening 25*a*. The suction opening 25*a* allows the flow of grout into the grout tube 22 but prevents the flow of grout in the opposite direction while the grout is being applied. A suction cup 22*a* is depicted in the grout tube 22. This suction cup 22*a* is pulled upwardly by using the grout handle 21. The suction created this movement fills the grout tube 22 with grout as it flows from the bucket 30 into the grout tube 22.

Inside cap 26 joins the grout tube 22 to the grout-dispensing channel 27. An exemplary dispensing tip 28 is also shown in FIG. 2. The dispensing tip 28 provides a means for the entry or the movement of grout from the grout channel 27. Above each dispensing tip is a small dispensing tube 32 that fills with grout as the grout is pressured downward through grout tube 22 into the grout-dispensing channel 27. Each dispensing tip 28 includes a depth adjuster 28*a*. The depth adjuster 28*a* provides a means to adjust the depth of dispensing tip 28 as grout is transferred from the dispensing channel 27 to dispensing tips 28.

The grout rake according to the present invention provides a means to maximize grout application and clean up. The grout rake 20 effectively applies grout into multiple gaps and although depicted with four dispensing tips, multiple dispensing tips may be incorporated in the grout rake according to the present invention. The grout rake utilizes a suction mechanism that provides multiple outlets of grout through the use thereof. The grout rake 20 therefore alleviates stress on ones back and knees that may be associated with manual grout application and also maximizes the plunger piston effect through the use of multiple dispensing outlets.

What is claimed is:

1. A grout dispensing system comprising:

a. a means for suction, where said means for suction draws grout material into an elongated tube;

b. a dispensing channel attached to first end of the elongated tube;

c. a suction handle extending through the elongated tube, where the suction handle draws grout into the tube when moved in a first direction and dispenses grout into the dispensing channel when moved in a second direction;

d. a plurality of dispensing tips disposed below the dispensing channel; and e. a squeegee on one side of the dispensing channel.

2. The grout dispensing system according to claim 1 where said means for suction includes a suction cup at one end of the suction handle, where said suction cup is within said elongated tube; a suction opening at a lower end of the elongated tube; and a suction tube extending from the suction opening.

3. The grout dispensing system according to claim 2, where the distal end of suction tube lies in a deposit of grout.

4. The grout dispensing system according to claim 1, where further including a grip handle extending from the elongated tube.

5. The grout dispensing system according to claim 1, where the elongated tube extends vertically at a height in the range of about 4.5 feet to about 5 feet.

6. The grout dispensing system according to claim 1, where each dispensing tip includes a depth adjuster, where said depth adjuster adjusts the depth of application of grout.

7. A grout dispensing system comprising:

a. a means for suction, where said means for suction means draws grout material into an elongated tube;

b. a dispensing channel attached to first end of the elongated tube;

c. a suction handle extending through the elongated tube, where the suction handle draws grout into the tube when moved in a first direction and dispenses grout into the dispensing channel when moved in a second direction;

d. four dispensing tips disposed below the dispensing channel; and e. a squeegee on one side of the dispensing channel.

8. The grout dispensing system according to claim 7, where said means for suction includes a suction cup at one end of the suction handle, where said suction cup is within said elongated tube; a suction opening at a lower end of the elongated tube; and a suction tube extending from the suction opening.

9. The grout dispensing system according to claim 8, where the distal end of suction tube lies in a deposit of grout.

10. The grout dispensing system according to claim 7, where further including a grip handle extending from the elongated tube.

11. The grout dispensing system according to claim 7, where the elongated tube extends vertically at a height in the range of about 4.5 feet to about 5 feet.

12. The grout dispensing system according to claim 7, where each dispensing tip includes a depth adjuster, where said depth adjuster adjusts the depth of application of grout.

* * * * *